US006752342B1

(12) United States Patent
Nagler

(10) Patent No.: US 6,752,342 B1
(45) Date of Patent: Jun. 22, 2004

(54) WATER OPERATED DEVICE FOR WINDING AND/OR UNWINDING A LENGTH OF FLEXIBLE MATERIAL ABOUT A SPOOL

(75) Inventor: Ehud Nagler, Kiryat Tivon (IL)

(73) Assignee: Hydro-Industries Tynet Ltd., Rosh Haayin (IL)

( * ) Notice: Subject to any disclaimer, the term of this patent is extended or adjusted under 35 U.S.C. 154(b) by 0 days.

(21) Appl. No.: 09/522,410

(22) Filed: Mar. 9, 2000

(51) Int. Cl.[7] ..... B65H 75/48

(52) U.S. Cl. ..... 242/390.5

(58) Field of Search ..... 242/390.5, 390.6; 254/361

(56) References Cited

U.S. PATENT DOCUMENTS 2,518,990 A * 8/1950 Keener ..... 242/390.5
2,898,605 A * 8/1959 Pearson ..... 242/390.5
3,471,885 A * 10/1969 McLoughlin et al. .... 242/390.5

* cited by examiner

*Primary Examiner*—John Q. Nguyen
(74) *Attorney, Agent, or Firm*—Mark M. Friedman

(57) ABSTRACT

A water flow operated device for winding and/or unwinding a length of flexible material. The device includes a stationary element, a spool with a central axis rotatably engaged by the stationary element and a water flow operated mechanism engaged by the stationary element. The water flow operated mechanism serves to controllably rotate the spool. The water flow operated mechanism includes a water operated motor, a water inlet communicable with a household water source, a water outlet and a valve for controlling a flow of water through the mechanism.

16 Claims, 11 Drawing Sheets

WATER OPERATED DEVICE FOR WINDING AND/OR UNWINDING A LENGTH OF FLEXIBLE MATERIAL ABOUT A SPOOL

FIELD AND BACKGROUND OF THE INVENTION

The present invention relates to a device operated by water flow for revolving a drum or spool about a central axis thereof so as to wind and/or unwind a length of a flexible material thereon or thereof, respectively. More particularly, the present invention relates to a device for winding and/or unwinding a length of flexible material, such as a hose, cable or chain, around a central axis of a spool or drum using water flow.

The use of hydraulic pressure combined with a suitable actuator (e.g., a piston) or a suitable motor (e.g., a vane motor, a gerotor internal gear motor, piston motor, an external gear motor, etc.) has long been used as direct means for moving objects or parts thereof. Such use of hydraulic pressure has three major characteristics. First, the hydraulic liquid is contained in a closed reservoir and is recycled. Second, due to lubrication and pressure resistance properties, the hydraulic liquid is typically selected to be oil. And third, the pressure is provided by an electrically operated device. One example of such use of hydraulic pressure is the amusement helicopter disclosed in U.S. Pat. No. 4,492,372 to Lorence et al.

The pressure associated with blocking a flow of water by an obstacle has been employed by mankind for centuries to move objects, perhaps the most familiar example is the water wheel of water driven flour mills, wherein the water flow is provided by a naturally occurring water stream (e.g., a river).

For the specific application of fluid operated bathtub lifts designed for invalid occupants, employed is a hydraulic pressure associated with an actuator, wherein the hydraulic liquid is household pressurized water discarded after use to a drain. Examples include U.S. Pat. Nos. 3,879,770 to Grant, 3,545,013 to Discoe, 3,381,317 to Daniels et al., and 5,279,004 to Walker.

For the specific application of a combined toy and water sprinkling device, employed is a hydraulic pressure associated with a vane motor, wherein the hydraulic liquid is household pressurized water which are used to water a lawn and operate the toy, as disclosed in U.S. Pat. No. 2,921,743 to Westover and Larson.

U.S. Pat. No. 5,741,188 teaches the use of water pressure as a sole means of operating ride-on toys and garden tools. Operation of these items is accomplished by causing water to flow through, and thereby operate, a water driven motor. Motor types described include a rotating motor, an external gear motor, a linearly translating actuator, and a rotatable actuator. In general, these motor types include those which transform a rotational movement to a translational movement and those which transform a. translational movement to a rotational movement. This patent does not teach gathering of any item external to the invention to a place within, or in close proximity to, the invention using the water driven motor of the invention. The specification of U.S. Pat. No. 5,741,188 is incorporated herein by reference.

Thus, the scope of the prior art in using water based hydraulic pressure in combination with an actuator or motor is limited to very specific applications.

Devices which serve to conveniently store flexible material, for example a garden hose, in winds around the central axis of a spool or drum are common. These devices typically include a rotatable spool (or drum) capable of accommodating a length of the flexible hose, a shaft with a handle and a means for connecting the device to a water supply so that the hose can be used for irrigation while connected to the device. As the length and diameter of the stored hose increase, the amount of effort required to rewind the hose onto the device after use increases, especially since the hose is generally filled with water during this procedure. A motor to supply the force to perform this procedure, and to a lesser extent to unwind the hose before use, would therefore be advantageous. However, since the device is generally used outside, electricity to power a motor may not always be available. In addition, operation of an electric motor in proximity to a device through which water flows presents a potential hazard of electric shock.

There is thus a widely recognized need for, and it would be highly advantageous to have, a device for winding a length of flexible material in winds around a spool which rely upon water flow to drive a motor capable of winding, or unwinding the hose.

SUMMARY OF THE INVENTION

According to the present invention there is provided a water flow operated device for winding and/or unwinding a length of flexible material which comprises: (a) a stationary element; (b) a spool having a central axis, the spool being rotatably engaged by the stationary element and being rotatable about the central axis; and (c) a water flow operated mechanism being engaged by the stationary element for controllably rotating the spool.

According to further features in preferred embodiments of the invention described below, the water flow operated mechanism includes: (i) a water operated motor; (ii) a water inlet for directing water into the water flow operated mechanism, the water inlet being communicable with a household water source; (iii) a water outlet for directing water out of the water flow operated mechanism; and (iv) a valve for controlling a flow of water through the water flow operated mechanism.

According to still further features in the described preferred embodiments, the water flow operated mechanism includes a water operated motor selected from the group consisting of an external gear motor, a vane motor, a gerotor internal gear motor, a rotating actuator, a piston motor, a converter for conversion of a linear motion to a rotational motion, or any other hydraulic motor.

According to still further features in the described preferred embodiments, the flexible material is at least partially wound on the spool.

According to still further features in the described preferred embodiments, the flexible material is selected from the group consisting of a hose, a rope, a cable, a chain and a wire.

According to still further features in the described preferred embodiments, the valve is selected from the group consisting of a linear selector valve and a rotating selector valve.

According to still further features in the described preferred embodiments, the valve has at least two operation states, an open operation state and a closed operation state.

According to still further features in the described preferred embodiments, the valve has at least two operation states, an operation state which directs water into the water flow operated mechanism and an operation state which directs water away from the water flow operated mechanism.

According to still further features in the described preferred embodiments, the operation state which directs water away from the water flow operated mechanism directs water to a channel is fluidally communicable with a hose.

According to still further features in the described preferred embodiments, a direction of rotation of the water operated motor is reversible such that the winding and unwinding of the length of flexible material are both performable by the water operated motor.

According to still further features in the described preferred embodiments, the valve has at least three operation states, a first operation state which directs water into the water flow operated mechanism, a second operation state which directs water to a channel being fluidally communicable with a hose and a third operation state which is a closed operation state.

According to still further features in the described preferred embodiments, the water outlet is fluidally communicable with a hose.

According to still further features in the described preferred embodiments, the water flow operated mechanism is fluidally communicable with a first water source and the hose is fluidally communicable with a second water source.

The present invention successfully addresses the shortcomings of the presently known configurations by providing a device for winding/unwinding a length of flexible material in winds around a spool which rely upon water flow to drive a motor capable of winding, or unwinding the flexible material. The device eliminates the need for an electric motor, thereby making the device operable in the absence of an electric power source and thereby reducing the hazard of electric shock, especially when used for "wet applications", such as winding/unwinding a garden water hose.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
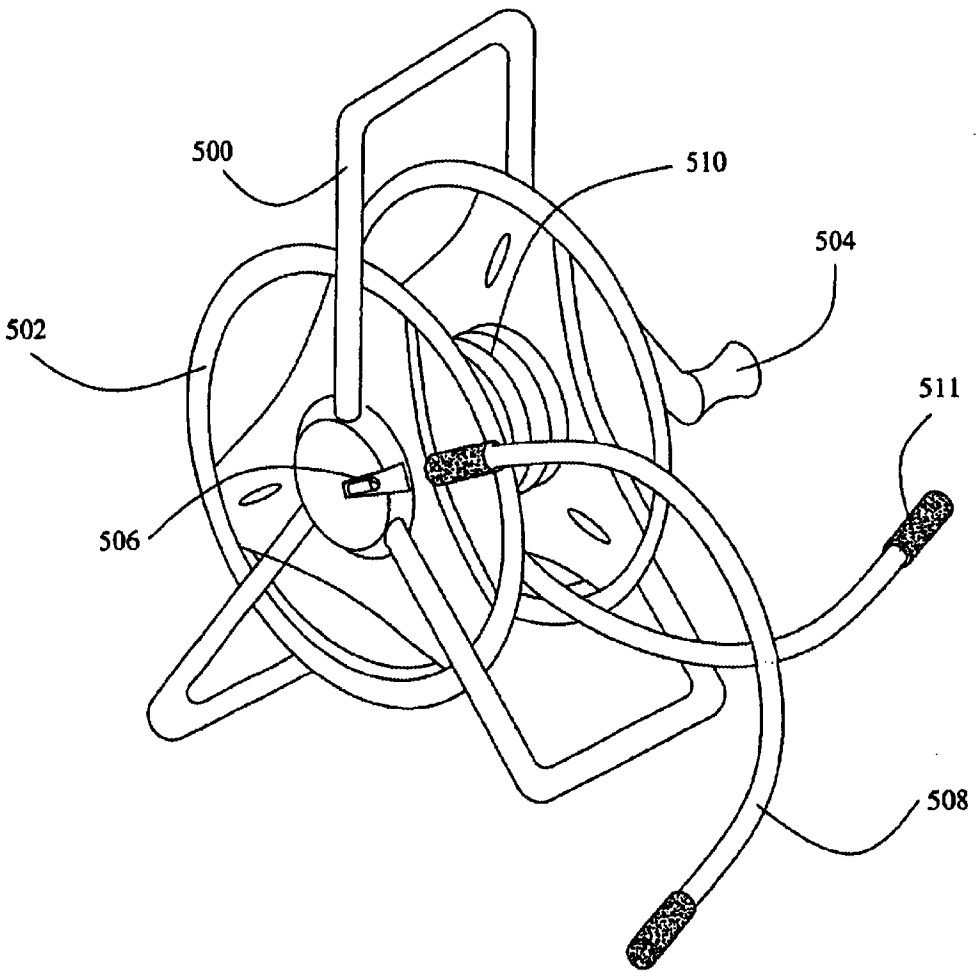
FIG. 1 is a perspective view of a prior art device.

The present invention is of a water flow operated device for winding and/or unwinding a length of flexible material. Specifically, the present invention can be used to wind and/or unwind materials including, but not limited to, a hose, a rope, a cable, a chain and a wire, wherein the energy source for winding/unwinding is provided by the household water pressure generating a water flow.

All devices according to the present invention are water flow operated and although may have various functions, designs, and intended uses, they all share a minimal set of unique components.

Thus, all devices for winding and/or unwinding a length of flexible material according to the present invention include a stationary element, a spool having a central axis, the spool being rotatably engaged by the stationary element and being rotatable about the central axis and a water flow operated mechanism being engaged by the stationary element for controllably rotating the spool.

According to preferred embodiments of the present invention, the water flow operated mechanism includes a water operated motor, a water inlet for directing water into the water flow operated mechanism, the water inlet being communicable with a household water source, a water outlet for directing water out of the water flow operated mechanism and a valve for controlling a flow of water through the water flow operated mechanism. Upon entering the water operated motor via the water inlet as controlled by the valve, the household water pressure enforces the water operated motor to move, and the water operated motor thereby rotates the spool relative to the stationary element and about its axis which can be either a real axis or a virtual axis.

According to preferred embodiments of the device of the present invention, the flexible material may be, but is not necessarily limited to, a hose, a rope, a cable, a chain or a wire.

The valve preferably has at least two operation states, an open operation state and a closed operation state. In this configuration, the water operated motor is either on or off, depending upon the operation state of the valve. Thus, According to another embodiment, the valve has at least two operation states, an operation state which directs water into the water flow operated mechanism and an operation state which directs water away from the water flow operated mechanism. In this configuration, the water operated motor is either on or off, depending upon the operation state of the valve.

According to a preferred embodiment of the present invention, the operation state which directs water away from the water flow operated mechanism directs water to a channel which is fluidally communicable with a hose. Such an arrangement allows a single water source to alternately operate the motor or flow through the hose.

According to another preferred embodiment of the present invention, the valve has at least three operation states, a first operation state which directs water into the water flow operated mechanism, a second operation state which directs water to a channel being fluidally communicable with a hose and a third operation state which is a closed operation state. Such an arrangement allows a single water source to alternately operate the motor or flow through the hose or be prevented from supplying water to the device.

According to preferred embodiments of the present invention, a direction of rotation of the water operated motor is reversible such that the winding and unwinding of the length of flexible material are both performable by the water operated motor. Detailed descriptions of designs of water operated motors which facilitate such a reversal are set forth hereinbelow.

According to preferred embodiments of the present invention, the water outlet is fluidally communicable with a hose. Such an arrangement allows for simultaneous operation of the motor and supply of water to the hose.

According to another embodiment, the water flow operated mechanism is fluidally communicable with a first water source and the hose is fluidally communicable with a second water source. Such an arrangement allows for independent control of water supply to the hose and to the water operated motor.

For purposes of better understanding the present invention, as illustrated in FIGS. 2 through 11 of the drawings, reference is first made to the construction and operation of a conventional (i.e., prior art) device as illustrated in FIG. 1.

Thus, FIG. 1 illustrates a device for winding a hose which includes a stationary element 500, a spool (drum) 502, a handled shaft 504 for rotating the spool, a water inlet 506, a hose for connection to water source 508, and a gardening hose 510. Hose 510 constitutes a length of flexible material to be wound/unwound by means of the device and does not form an integral part of the device itself. This prior art device serves to wind hose 510 about spool 502 when handled shaft 504 is turned in one direction. Unwinding hose 510 is effected either by pulling on the water dispensing end 511 of hose 510 or by turning handled shaft 504 in a reverse direction. Water may enter water inlet 506 from hose 508 and proceed through hose 510, which is fluidally connectable to water inlet 506 (connecting mechanism not pictured). Water then flows from hose 510 at an end distal to spool 502. The important difference between this prior art device and the devices of the present invention is that water flowing through the prior art device cannot rotate spool 502 to wind hose 510 thereupon or unwind hose 510 therefrom. It will be appreciated by those skilled in the art that stationary element 500 may be embodied by, for example, a single rod passing through a central axis of spool 502.

The above terms, and the principles and operation of water operated devices according to the present invention may be better understood with reference to the drawings and accompanying descriptions, which are provided as examples and are therefore not intended to limit the scope of the present invention.

Figure 2:
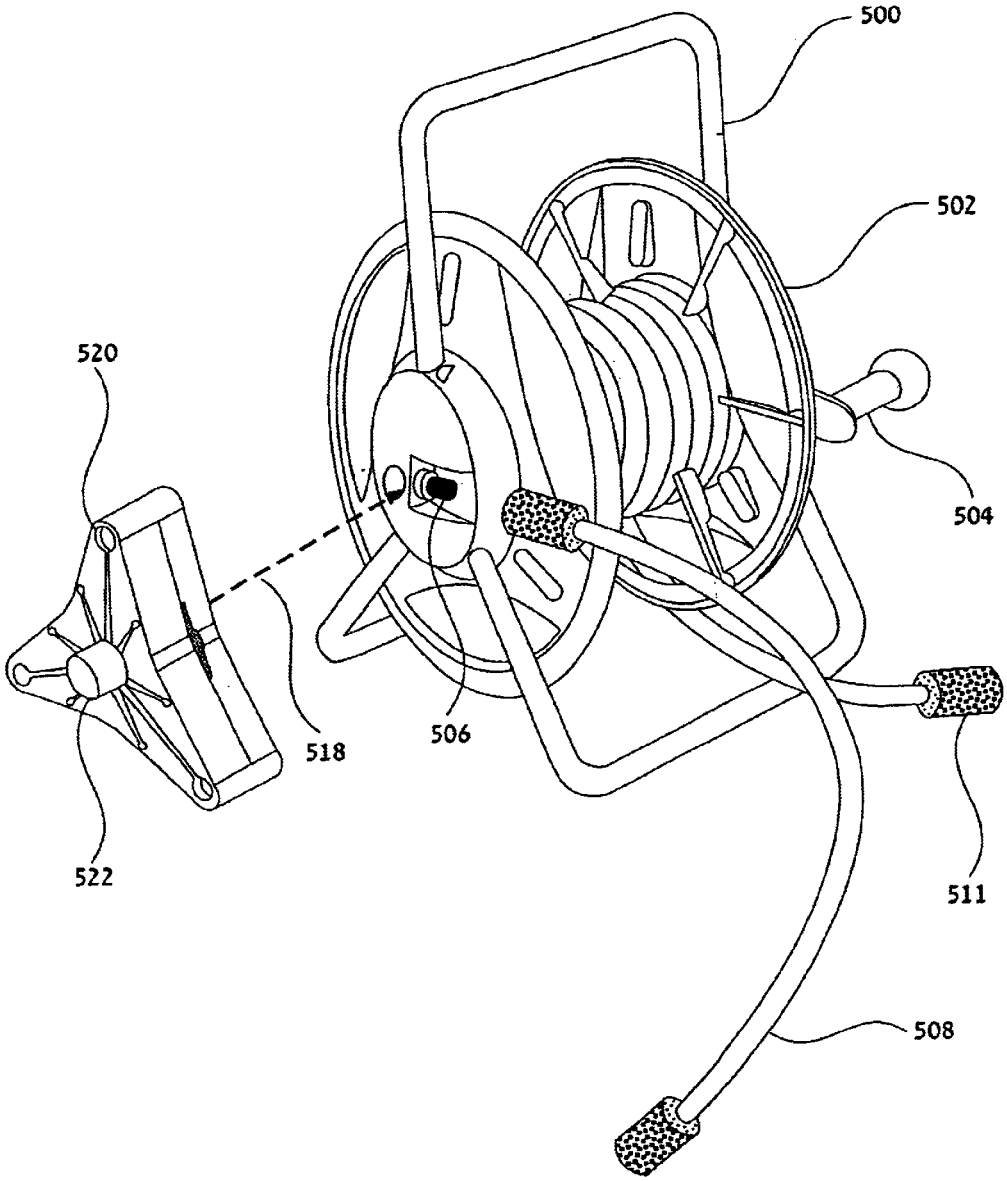
FIG. 2 is a perspective view of one embodiment of the device of the present invention.
Figure 3:
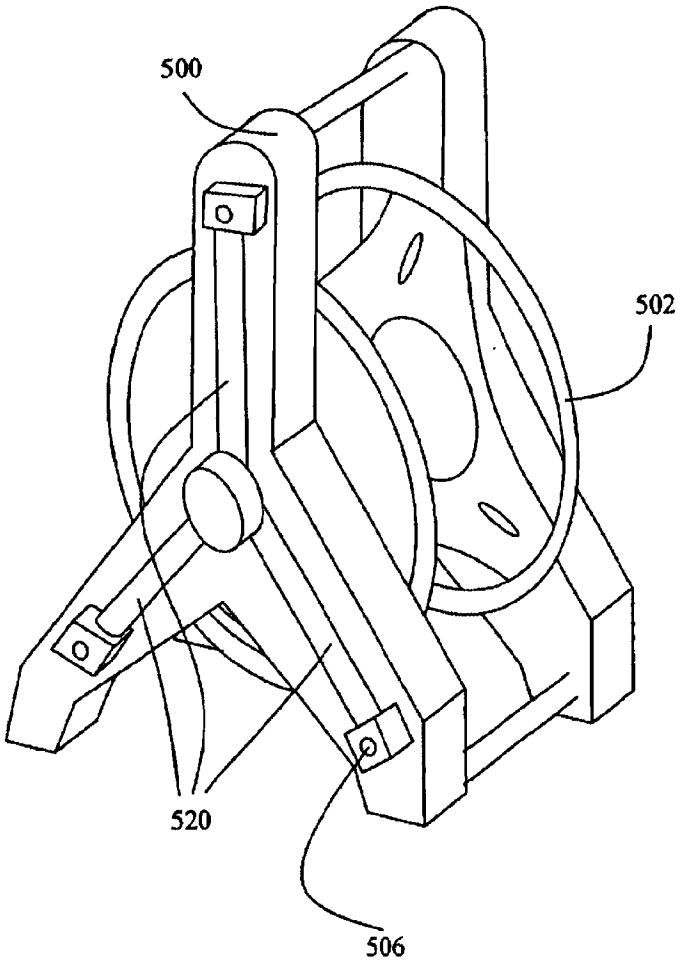
FIG. 3 is a perspective view of a second embodiment of the device of the present invention.

FIGS. 2 and 3 show how addition of water flow operated mechanism 520 to stationary element 500 may transform a prior art device into a device in accordance with the teachings of the present invention.

Thus, FIG. 2 shows connection 518 (dashed arrow) of a separate water flow operated mechanism 520 operatively mountable on stationary element 500. FIG. 2 also shows how hose 508 may be connected to water flow operated mechanism 520 by means of connector 522.

FIG. 3 shows integral construction of water flow operated mechanism 520 as part of stationary element 500.

With reference now to FIGS. 4–8, shown are examples of water operated motors suited for use in water flow operated mechanisms which may be implemented (one or more) in a device according to the present invention.

Figure 4:
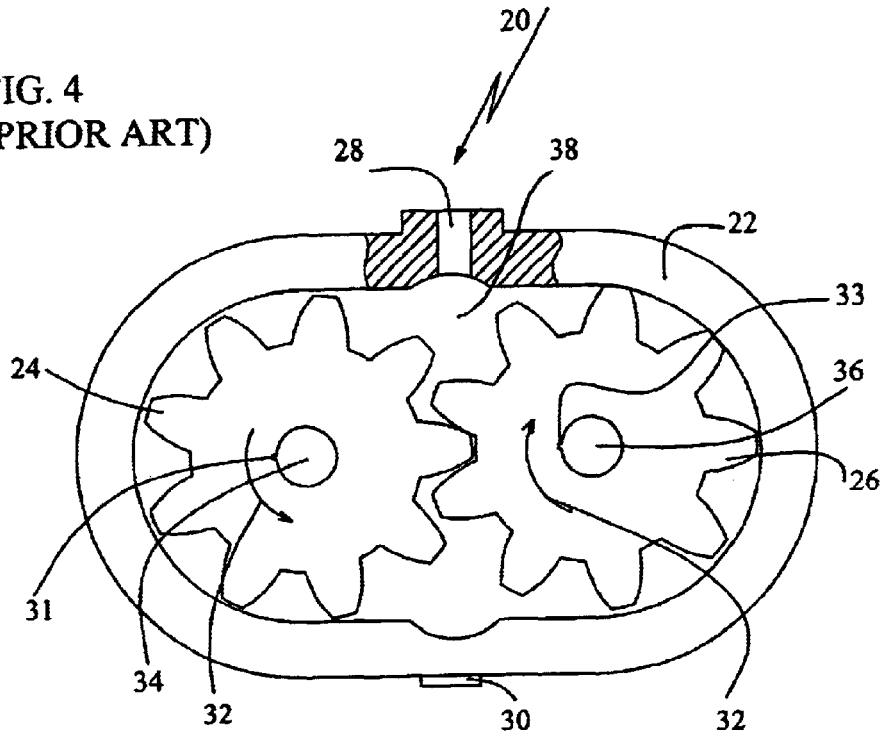
FIG. 4 (PRIOR ART)
FIG. 4 is a cross-sectional view of an external gear motor used as a water operated motor to operate the devices according to the present invention.

FIG. 4 shows a rotating element in the form of an external gear motor, referred to hereinbelow as motor 20.

Motor 20 includes a housing 22, engaging a first 24 and a second 26 gears. Housing 20 is formed with a water inlet 28 and a water outlet 30. Gears 24 and 26 and housing 22 are sized and arranged such that water forced through inlet 28 would apply pressure on gears 24 and 26 such that they are forced to rotate as indicated by arrows 32. One of gears 24 and 26, say gear 24, is fixedly connected, as indicated by pin 31, to an idle shaft 34 itself rotatably accommodated by housing 20, whereas the other gear, say 26, is fixedly connected, as indicated by pin 33, to a motor shaft 36 itself rotatably accommodated by housing 20.

The operation of motor 20 is as follows. When a valve (not shown) which controls water inlet 28 is opened, water enters housing 20 via inlet 28 and pressure is built in a space 38 formed between gears 24 and 26 and housing 22. The pressure thus built forces gears 24 and 26 to rotate as indicated by arrows 32, and as a result motor shaft 36 rotates, and a movable element (not shown) connected thereto rotates therewith. This rotation serves to rotate spool 502 (FIG. 2) either directly, or by mechanism of an intermediate device such as, for example, a belt or gears.

It is clear to one ordinarily skilled in the art that the direction of rotation of motor 20 can be determined by selecting appropriate positions for water inlet 28 and outlet 30. It is further appreciated that by having valves which can function alternately as permitting water in or out, outlet 30 may also function as an inlet and inlet 28 may also function as an outlet, to enable selecting the direction of rotation. Such an arrangement makes the direction of rotation of the water operated motor reversible, such that the winding and unwinding of the length of flexible material are both performable by the water operated motor.

As is understood by one ordinarily skilled in the art, other water operated motors may be used similarly to motor 20. Examples of water operated motors are further exemplified in FIGS. 5–8.

Figure 5:
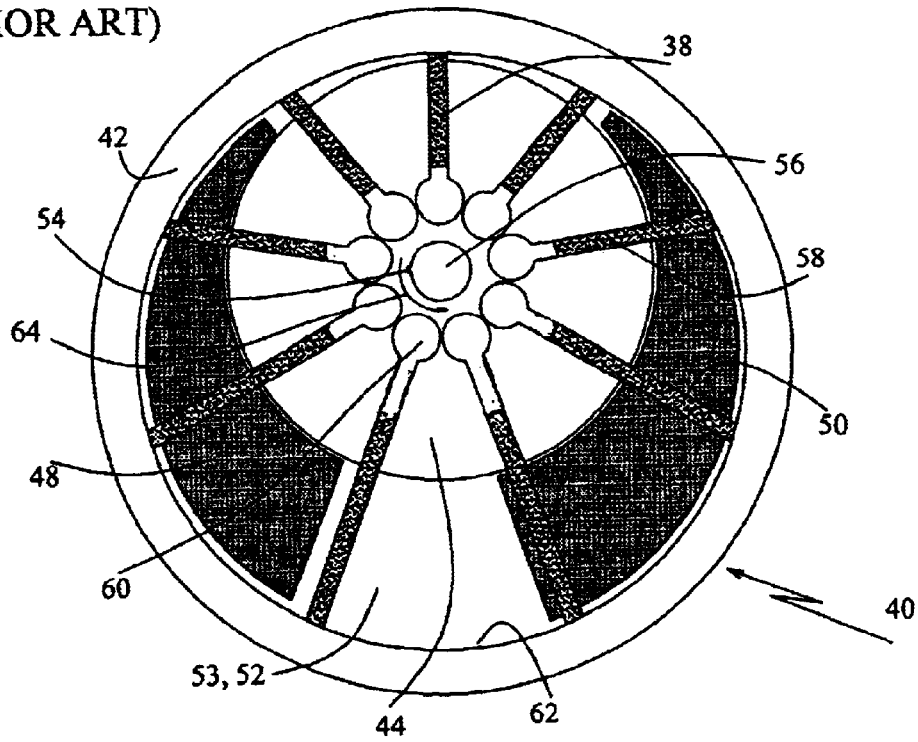
FIG. 5 (PRIOR ART)
FIG. 5 is a cross-sectional view of a prior art vane motor used as an alternative water operated motor to operate the devices according to the present invention.

FIG. 5 shows another type of water operated motor, in the form of a vane motor, referred to hereinbelow as motor 40.

Motor 40 includes a housing 42 defining a space 52 for engaging a rotor 44, such that the diameter of space 52 is larger than the diameter of rotor 44 and an asymmetric gap 53 is formed between rotor 44 and housing 42. Housing 42 is formed with a water inlet 48 and a water outlet 50. Rotor 44 is fixedly connected, as indicated by pin 54, to a motor shaft 56, itself rotatably accommodated by housing 42. Rotor 44 includes vane elements 58 extending towards the inner walls 62 of housing 42. Each of vane elements 58 is transitionally accommodated in a specified cavity 60 formed in rotor 44. Each of cavities 60 is supplemented with a biasing mechanism (not shown) forcing each of vane elements 58 onto inner walls 62 of housing 42.

The operation of motor 40 is as follows. When a valve (not shown) controlling water inlet 48 is opened, water enter housing 42 via inlet 48 and a directional pressure is built and forces vane elements 58 and as a result, rotor 44 and shaft 56 to rotate in the direction indicated by arrow 64.

It is clear to one ordinarily skilled in the art that the direction of rotation can be determined by selecting appropriate positions for water inlet 48 and outlet 50. It is further appreciated that by having valves which can function alternately as permitting water in or out, outlet 50 may also function as an inlet and inlet 48 may also function as an outlet, to enable selecting the direction of rotation of motor 40. Such an arrangement makes the direction of rotation of the water operated motor reversible, such that the winding and unwinding of the length of flexible material are both performable by the water operated motor.

Figure 6:
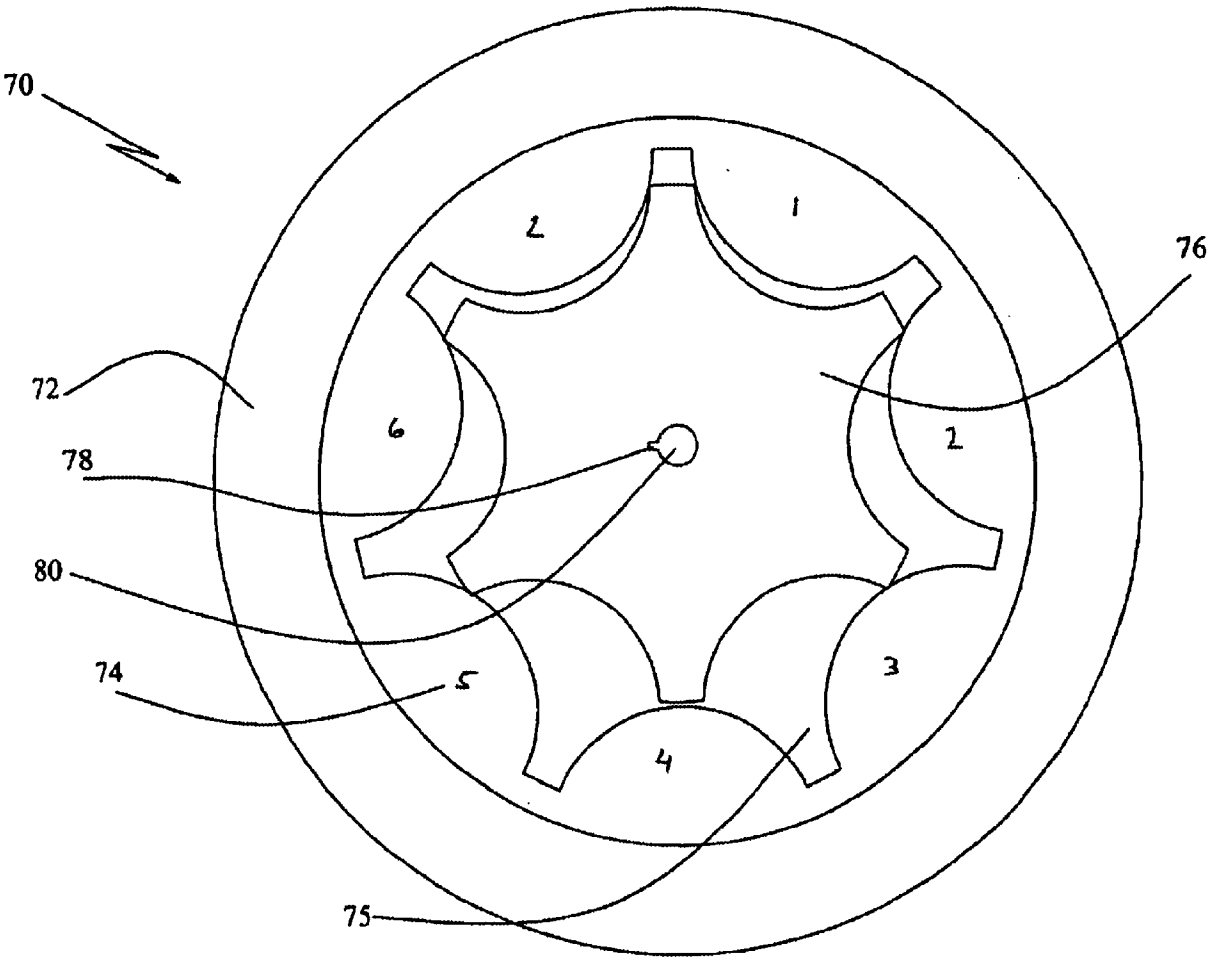
FIG. 6 (PRIOR ART)
FIG. 6 is a cross-sectional view of a prior art gerotor internal gear motor used as an alternative water operated motor to operate the devices according to the present invention.

FIG. 6 shows yet another type of water operated motor, in the form of a gerotor internal gear motor, referred to hereinbelow as motor 70. Motor 70 includes a housing 72, rotatably engaging an outer rotating element 74 formed with a space 75. An inner rotor 76 shaped as a star or the like is asymmetrically engaged within space 75. Housing 72 is formed with a water inlet (not shown) and a water outlet (not shown), both in communication with space 75. Rotor 76 is fixedly connected, as indicated by pin 78, to a motor shaft 80, itself rotatably accommodated by housing 42.

The operation of motor 70 is as follows. When a valve (not shown) controlling the water inlet is opened, water enter into space 75 via the inlet and a directional pressure is built and forces rotor 76, and as a result outer rotating element 74 and shaft 80, to rotate in a predefined direction away from the directional pressure formed by the water entering through the inlet.

It is clear to one ordinarily skilled in the art that the direction of rotation can be determined by selecting appropriate positions for the water inlet and outlet. It is further appreciated that by selecting valves which can function alternately as permitting water in or out, each outlet may also function as an inlet and vice versa, to enable selecting the direction of rotation of motor 70. Such an arrangement makes the direction of rotation of the water operated motor reversible, such that the winding and unwinding of the length of flexible material are both performable by the water operated motor.

Figure 7:
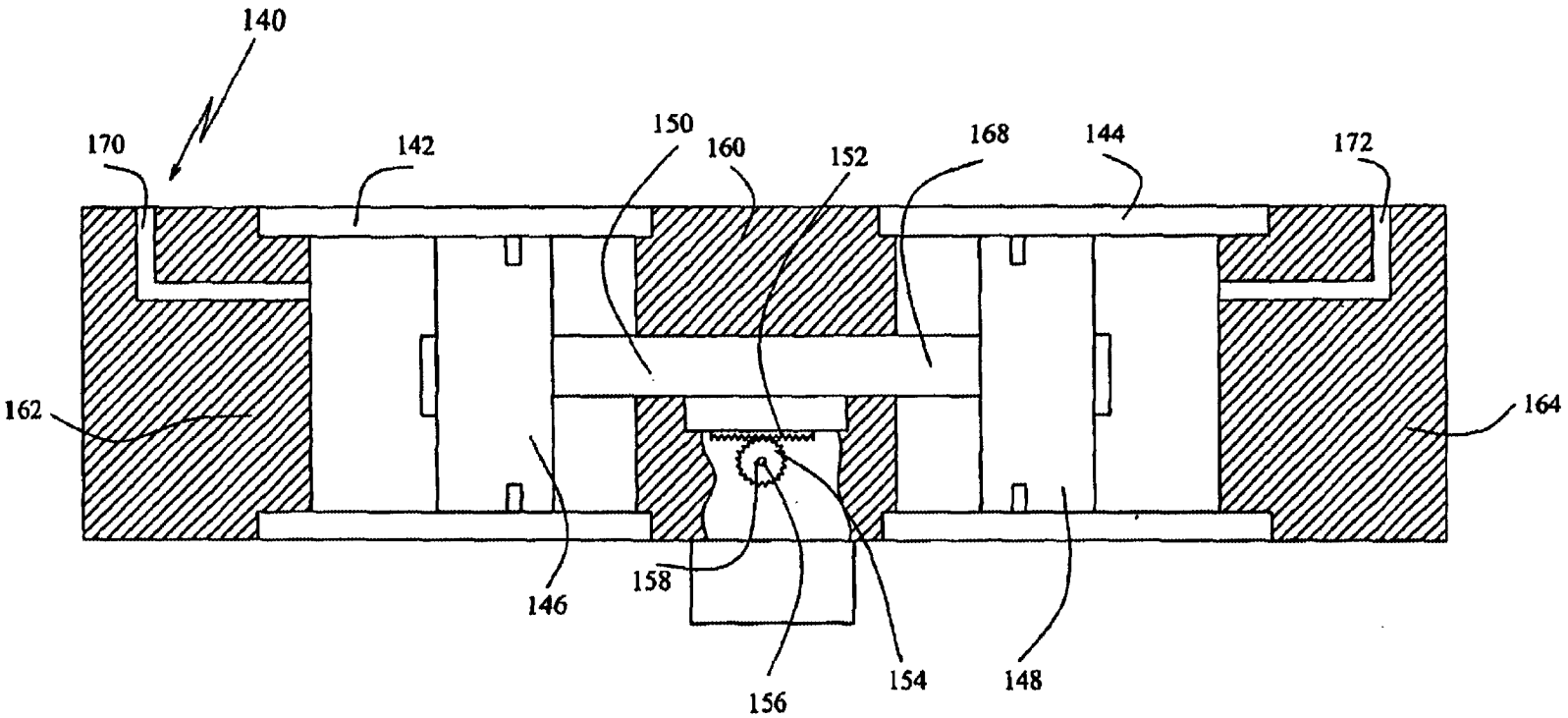
FIG. 7 (PRIOR ART)
FIG. 7 is a cross-sectional view of a prior art element suitable for conversion of linear motion to rotary motion used as an alternative water operated motor to operate the devices according to the present invention.

FIG. 7 shows a type of water operated motor suitable for conversion of a linear motion to a rotational motion, referred to hereinbelow as converter 140, which can be implemented in the devices according to the present invention.

Converter 140 includes a first 142 and a second 144 cylinders, within each translatably engaged is a piston 146 and 148, respectively. Pistons 146 and 148 are connected therebetween by a rod supplemented with a rack 152. Rack 152 is in gear contact with a gear 154, fixedly connected to a shaft 156 as indicated by pin 158, shaft 158 is rotatably accommodated by a housing 160 which also operates as internal covers of cylinders 142 and 144. Housing 160 is formed with a channel 168 for accommodating rod 150. Cylinders 142 and 144 are further supplemented with end covers 162 and 164, respectively, each of end covers 162 and 164 includes a water inlet/outlet 170 and 172, respectively. Operating converter 140 is by controlling the operation of water inlet/outlets 170 and 172, causing rod 150 and rack 152 to translate and therefore to rotate gear 154 and shaft 156.

Figure 8:
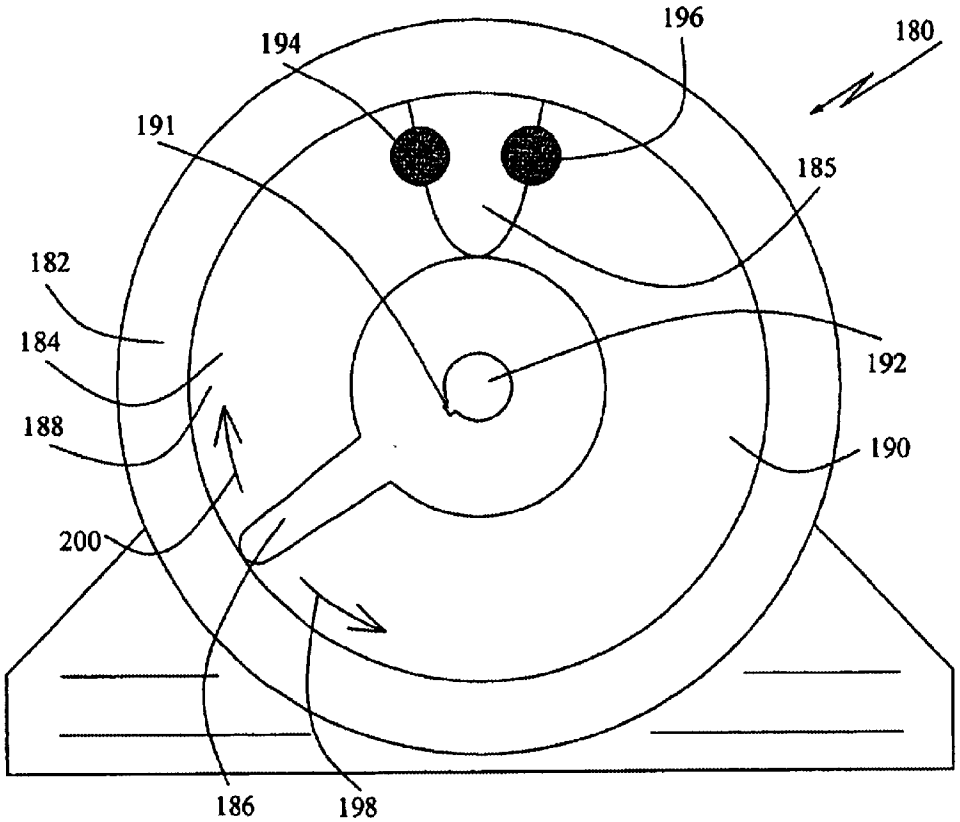
FIG. 8 (PRIOR ART)
FIG. 8 is a cross-sectional view of a prior art rotating actuator used as an alternative water operated motor to operate the devices according to the present invention.

FIG. 8 shows a type of water operated motor in the form of a rotating actuator, referred to hereinbelow as actuator 180, which can be implemented in the devices according to the present invention.

Actuator 180 includes a housing 182 formed having an internal space 184 disturbed by a stoppage 185 protruding into space 184. Actuator 180 further includes a rotating pointer 186, dividing space 184 into a first 188 and a second 190 parts. Rotating pointer 186 is fixedly attached, as indicated by pin 191, to a shaft 192, shaft 192 is rotatably accommodated by housing 180. Actuator 180 further includes a first 194 and a second 196 water inlets/outlets.

The operation of actuator 180 is as follows. When pressurized water enter via one of the water inlets 194 and 196, say 194, into one part, say 188, of space 184, pointer 186 and thus shaft 192 are forced to rotate as indicated by arrow 198, and water from the other part, say 190, of space 184 are forced to leave via water outlet 196, whereas when pressurized water enter the other part, say 190, pointer 186 and thus shaft 192 are forced to rotate to the opposite direction as indicated by arrow 200.

FIGS. 4–8 described hereinabove thus show various examples of water operated motors suited for use in water flow operated mechanisms as used herein and in the claims section to follow.

Operating water operated motors suited for use in water flow operated mechanisms according to the present invention is by a water flow which is controlled by valve(s). The valve(s) according to the present invention may be of various types, accomplish various functions and operate according to various mechanisms, including, but not limited to, a linear selector valve and a rotating selector valve (FIGS. 9 and 10).

Figure 9:
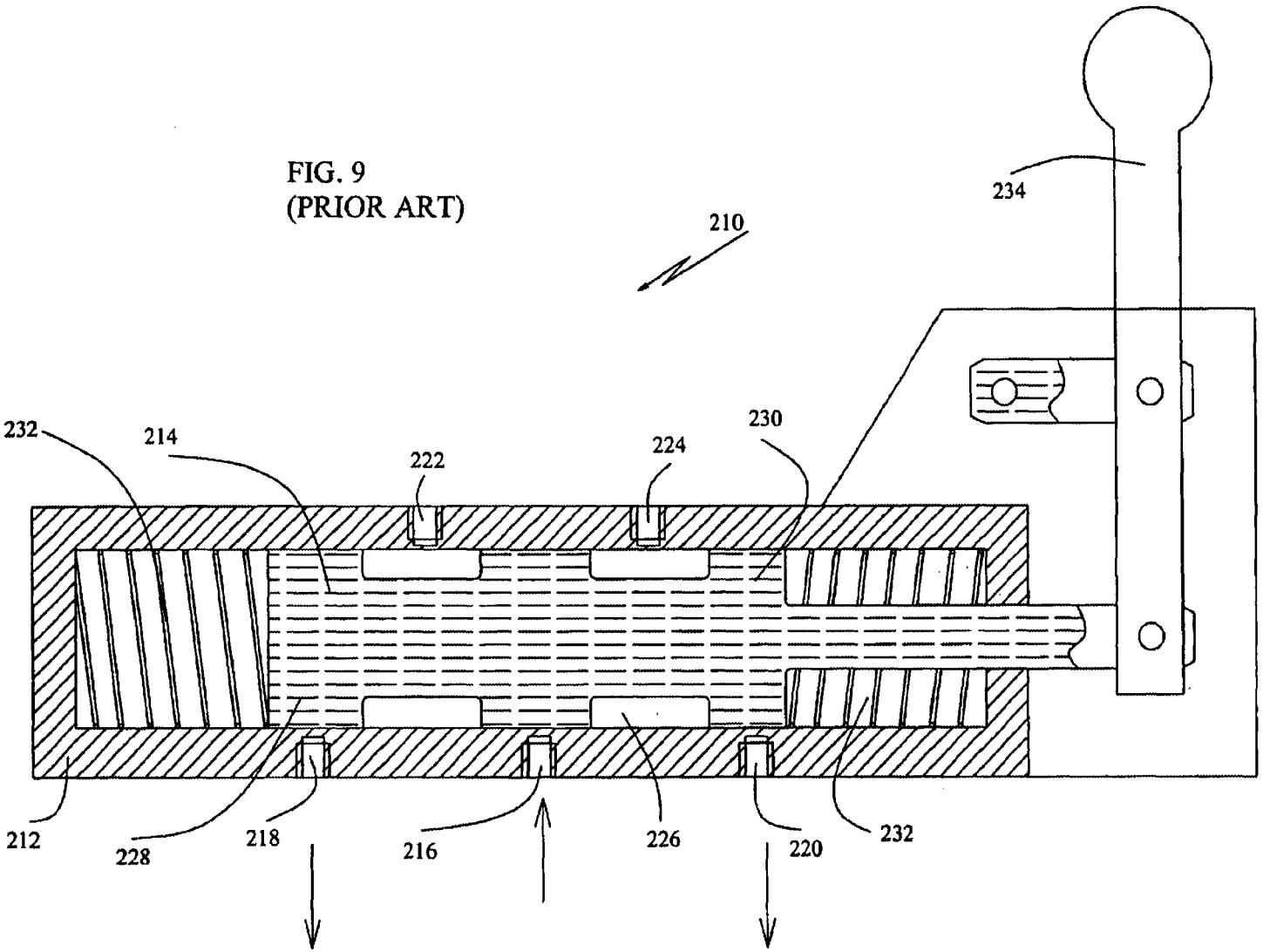
FIG. 9 (PRIOR ART)
FIG. 9 is a cross-sectional view of a prior art linear selector valve implemented, according to some embodiments, in the devices according to the present invention.

FIG. 9 shows a possible configuration of a linear selector valve, referred to hereinbelow as selector valve 210. Selector valve 210 includes a housing 212 accommodating a plunger 214. Housing 212 is formed having a pressurized water inlet 216, a first 218 and a second 220 drains and a first 222 and a second 224 pressurized water outlets. Plunger 214 includes a central valve 226 and two peripheral valves 228 and 230. Valves 228 and 230, inlet 216, drains 218 and 220 and pressurized water outlets 222 and 224 are arranged such that three operation modes exist for selector valve 210. In the first, valve 226 blocks inlet 216 and no water flow through selector valve 210. Selector valve 210 is maintained at the first operation mode by biasing mechanism (e.g., springs) 232, rendering this mode the default mode. In the second mode of operation, plunger 214 is translated via a lever 234 connected thereto such that inlet 226 becomes in communication with outlet 224 and drain 218 becomes in communication with outlet 222. And finally, in the third mode of operation, plunger 214 is translated via lever 234 such that inlet 226 becomes in communication with outlet 222 and drain 220 becomes in communication with outlet 224. Pressurized water outlets 222 and 224 are communicated to water outlets/inlets of any of the above described water operated motors (FIGS. 4–8) and may thus function both as pressurized water suppliers and as drains.

Figure 12:
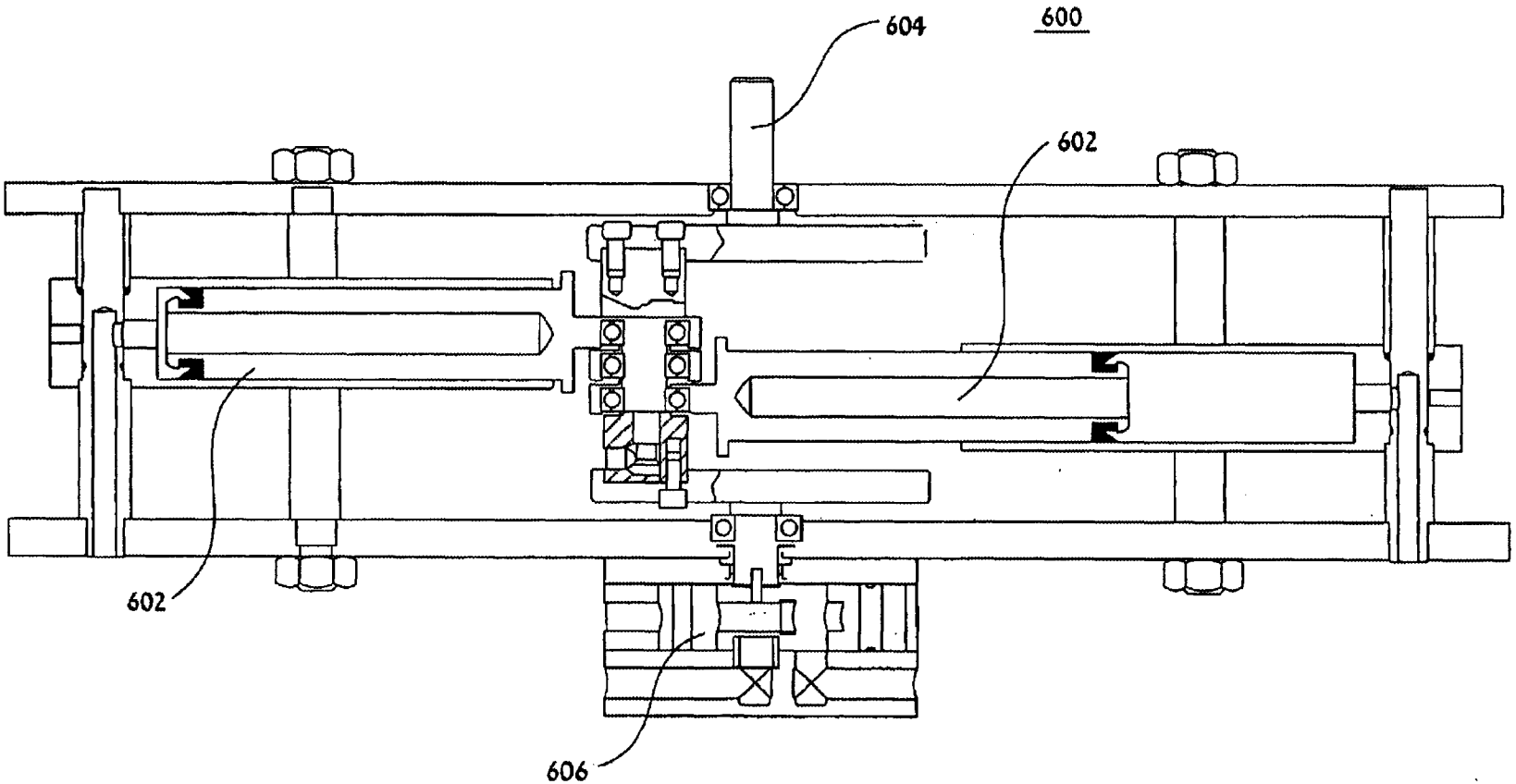
FIG. 12 is a cross sectional view of a piston motor usable while implementing the present invention.

According to a preferred embodiment of the present invention, and as is specifically shown in FIG. 12, a piston motor 600 having at least two water operated pistons 602 arranged and designed to rotate a main (crank) shaft 604 are alternately operated by water directed thereto by a distribution valve assembly 606, so as to rotate shaft 604, all as is well known in the art.

Figure 10C:
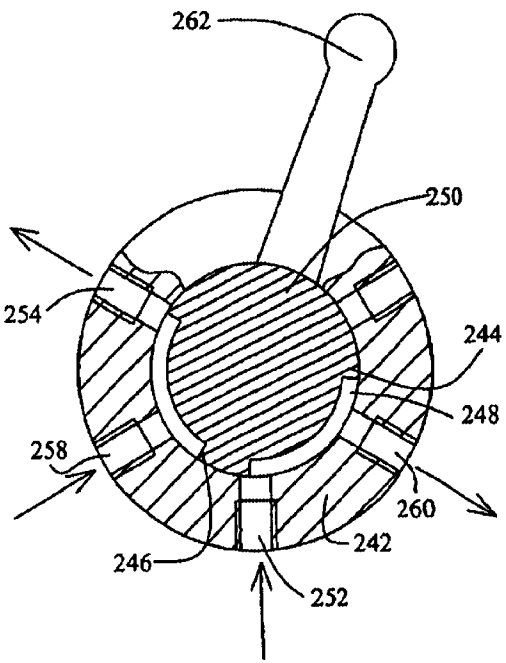
FIG. 10c (PRIOR ART)
FIGS. 10*a–c* are cross-sectional views of a prior art rotating selector valve implemented according to other embodiments in the devices according to the present invention in three operation modes.
Figure 10B:
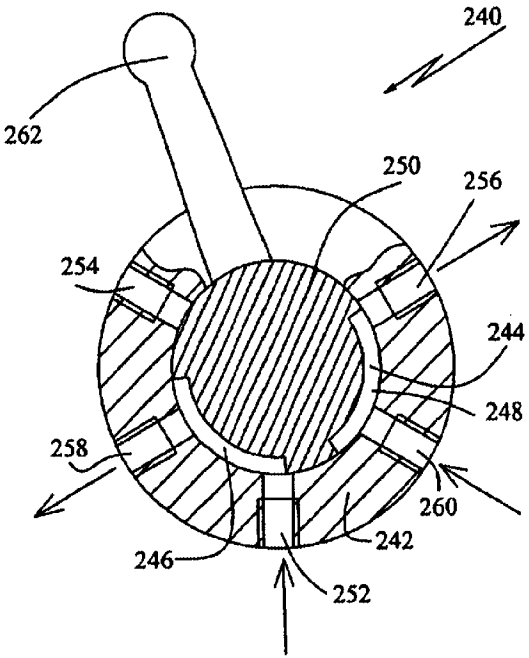
FIG. 10b (PRIOR ART)
Figure 10A:
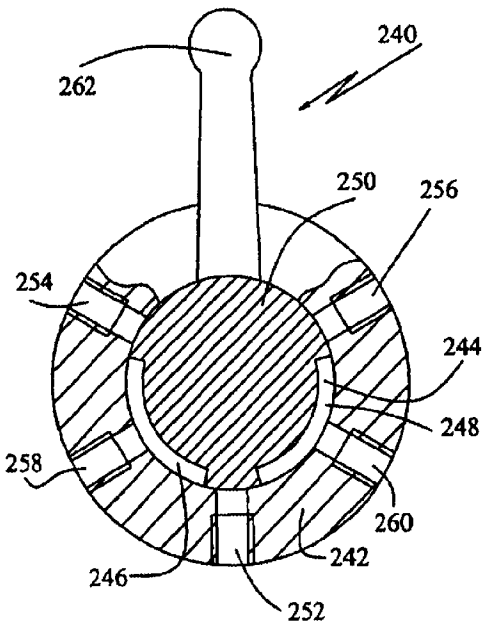
FIG. 10a (PRIOR ART)

FIGS. 10*a–c* show possible configurations of a rotating selector valve, referred to hereinbelow as selector valve 240. Selector valve 240 includes a housing 242 defining a space 244 divided into a first 246 and a second 248 sections by a rotatable spool valve 250. Housing 242 is formed having a pressurized water inlet 252, a first 254 and a second 256 drains and a first 258 and a second 260 pressurized water outlets. Spool valve 250 is manually rotatable in either direction by a lever 262 connected thereto. The locations of sections 246 and 248, inlet 252, drains 254 and 256 and pressurized water outlets 258 and 260 are selected such that three operation modes exist for selector valve 240. In the first, shown in FIG. 10*a,* spool valve 250 blocks inlet 252. In the second, shown in FIG. 10*b,* inlet 252 and outlet 258 are in communication via section 246 of space 244, whereas drain 256 is in communication with outlet 260 via section 248 of space 244. And finally, in the third, shown in FIG. 10*c,* inlet 252 and outlet 260 are in communication via section 248 of space 244, whereas drain 254 is in communication with outlet 258 via section 246 of space 244.

Figure 11:
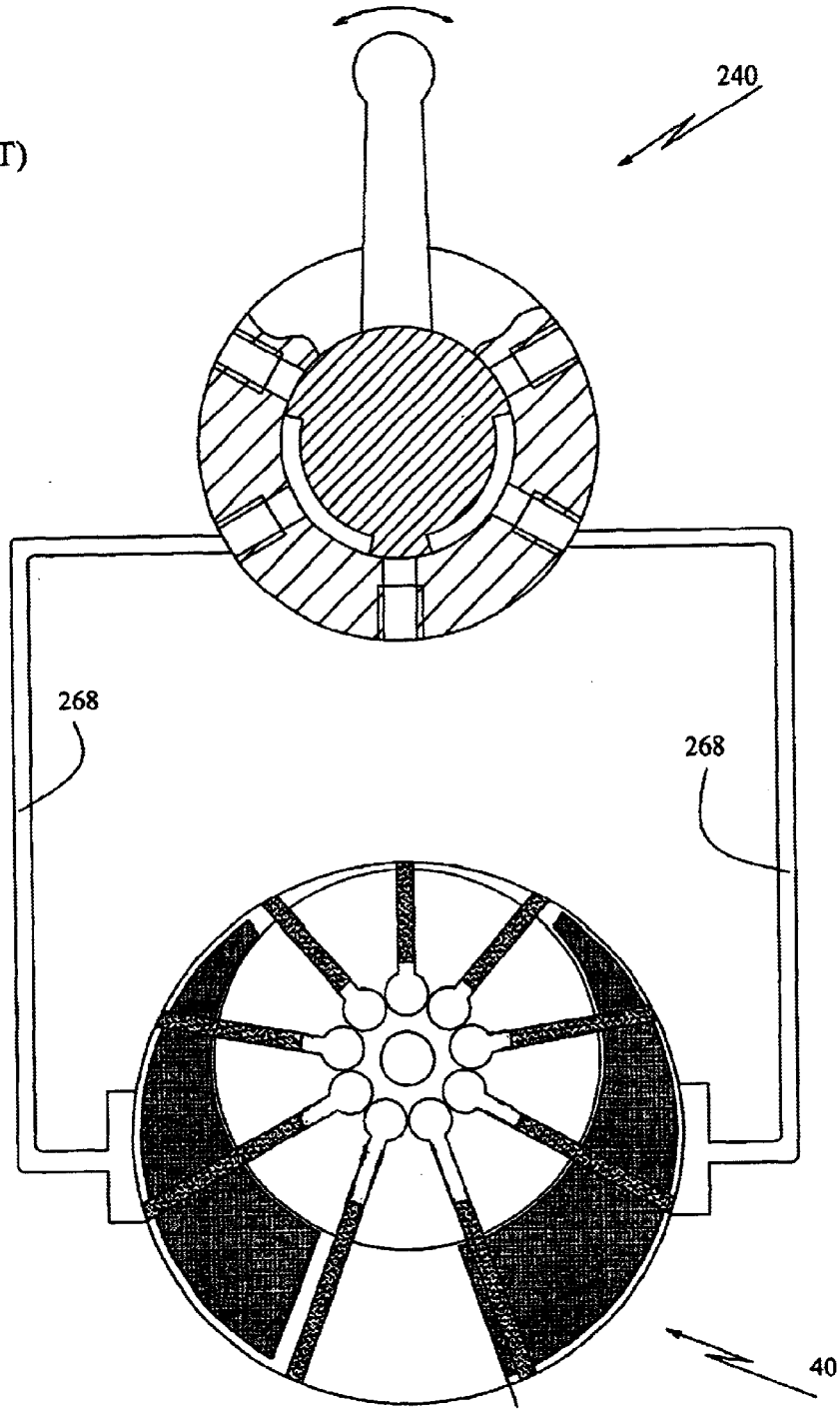
FIG. 11 (PRIOR ART)
FIG. 11 is a cross-sectional view of the rotating selector valve of FIG. 9 connected to the vane motor of FIG. 5.

FIG. 11 shows a possible connection of selector valve 240 of FIGS. 10*a–c* with vane motor 40 of FIG. 5 using water tubes 268. As is apparent to one ordinarily skilled in the art, in both cases, selecting the operation mode of selector valve 240 as described above under FIGS. 10*a–c,* dictates the direction of operation of motor 40.

Any of the water operated motors presented in FIGS. 4–8 and 12, or other similar mechanisms, may be implemented in a device of the present invention. Furthermore, either of the valves of FIGS. 9–10 or any other valve may be used to control the water flow through the water operated motor in a device of the present invention.

It will be appreciated by one ordinarily skilled in the art that various types of implementations may be further implemented in devices according to the present invention. Thus for example a frequency meter, a valve controller and a flow rate regulator may be implemented in any of the devices to further control their operation.

As mentioned throughout this disclosure, devices of the present invention are water flow operated. A household water pressure (e.g., from the city water net) is typically in the range of 1–6 Atmospheres and is sufficient to operate a device of the present invention. Relying upon water, the devices according to the invention enjoy various advantages as compared with equivalent devices supplemented with an manual, electrical or internal combustion engine. Devices including an electrical or internal combustion engines are (i) expensive as compared to the inventive devices; (ii) noisier; (iii) present a risk of electric shock and (iv) increase air pollution. Devices according to the present invention on the other hand are simple to manufacture and may be easily operated both outdoors and indoors (provided they are connected to the drain).

Thus, although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications cited herein are incorporated by reference in their entirety. Citation or identification of any reference in this application shall not be construed as an admission that such reference is available as prior art to the present invention.

What is claimed is:

1. A water flow operated device for winding and/or unwinding a length of flexible material, the device comprising:

(a) a stationary element;

(b) a spool having a central axis, said spool being rotatably engaged by said stationary element and being rotatable about said central axis; and (c) a water flow operated mechanism being engaged by said stationary element for controllably rotation said spool, said water operated mechanism including:

(i) a water operated piston motor having at least two water operated pistons mechanically linked to said spool, and a distribution valve assembly for selectively directing water to said pistons so as to rotate said spool;

(ii) a water inlet for directing water into said water flow operated mechanism, said water inlet being communicable with a household water source;

(iii) a water outlet for directing water out of said water flow operated mechanism; and (iv) a control valve for controlling a flow of water through said water flow operated mechanism.

2. The device of claim 1, wherein said at least two water operated pistons are implemented as at least three water operated pistons.

3. The device of claim 1, wherein said water operated piston motor is configured to be operated by a domestic water supply.

4. The device of claim 1, further comprising said flexible material being at least partially wound on said spool.

5. The device of claim 4, wherein said flexible material is selected from the group consisting of a hose, a rope, a cable, a chain and a wire.

6. The device of claim 4, wherein said flexible material is a hose, and wherein said water flow operated mechanism is fluidally communicable with a first water source and said hose is fluidally communicable with a second water source.

7. The device of claim 1, wherein said control valve has at least two operation states, an open operation state and a closed operation state.

8. The device of claim 1, wherein said control valve has at least two operation states, an operation state which directs water away from said water flow operated mechanism.

9. The device of claim 8, wherein said operation state which directs water away from said water flow operated mechanism directs water to a channel being fluidally communicable with a hose.

10. The device of claim 1, wherein a direction of rotation of said water operated motor is reversible such that the winding and unwinding of the length of flexible material are both performable by said water operated motor.

11. The device of claim 1, wherein said control valve has at least three operation states, a first operation state which directs water into said water flow operated mechanism, a second operation state which directs water to a channel being fluidally communicable with a hose and a third operation state which is a closed operation state.

12. The device of claim 1, wherein said control valve is selected from the group consisting of a linear selector valve and a rotating selector valve.

13. A water flow operated device for winding and/or unwinding a length of flexible material, the device comprising:

(a) a stationary element;

(b) a spool having a central axis, said spool being rotatably engaged by said stationary element and being rotatable about said central axis; and (c) a water flow operated mechanism being engaged by said stationary element for controllably rotating said spool by connection to an output linkage, said water operated mechanism including:

(i) a static-pressure-responsive water operated motor configured for driving said output linkage through unlimited revolutions;

(ii) a water inlet for directing water into said water flow operated mechanism, said water inlet being communicable with a household water source;

(iii) a water outlet for directing water out of said water flow operated mechanism; and (iv) a valve for controlling a flow of water through said water flow operated mechanism, wherein said valve has at least two operation states including a first operation state in which said valve directs water into said water flow operated mechanism for subsequent release to a drain and a second operation state in which said valve directs water away from said water flow operated mechanism, wherein said second operational state directs water to a channel in fluid communication with a hose.

14. The device of claim 13, wherein said water operated motor is implemented as a water operated piston motor having at least two water operated pistons mechanically linked to said spool, and a distribution valve assembly for selectively directing water to said pistons so as to rotate said spool.

15. The device of claim 14, wherein said at least two water operated pistons are implemented as at least three water operated pistons.

16. The device of claim 13, wherein said water operated motor is configured to be operated by a domestic water supply.

* * * * *